US006164103A

United States Patent [19]

Pichler et al.

[11] Patent Number: 6,164,103

[45] Date of Patent: Dec. 26, 2000

[54] METHOD FOR IMPROVING THE CONTOUR OF ROLLED MATERIAL

[75] Inventors: Rudolf Pichler, Rottenegg; Sonja Tichy, Linz; Franz Holy, Herzogsdorf; Alois Seilinger, Linz, all of Austria

[73] Assignee: Voest-Alpine Industrieanlagenbau GmbH, Linz, Austria

[21] Appl. No.: 09/300,840

[22] Filed: Apr. 28, 1999

[30] Foreign Application Priority Data

Apr. 29, 1998 [AT] Austria ..... 715/98

[51] Int. Cl.[7] ..... B21B 37/24

[52] U.S. Cl. ..... 72/7.1; 72/10.1; 72/10.7; 72/247; 72/365.2; 700/148; 700/149

[58] Field of Search ..... 72/7.1, 7.2, 8.1, 72/10.1, 10.7, 13.4, 14.1, 247, 12.1, 365.2; 364/472.04; 700/148, 149

[56] References Cited

U.S. PATENT DOCUMENTS

| | | | |
|---|---|---|---|
| 5,448,901 | 9/1995 | Yu et al. | 78/8 |
| 5,592,846 | 1/1997 | Watanabe et al. | 72/247 |
| 5,727,127 | 3/1998 | Schulze Horn et al. | 395/10 |
| 5,796,922 | 8/1998 | Smith | 392/22 |
| 5,943,896 | 8/1999 | Rosenthal et al. | 72/252.5 |
| 5,950,478 | 9/1999 | Sato et al. | 72/11.7 |

FOREIGN PATENT DOCUMENTS

| | | |
|---|---|---|
| 0219844 | 1/1991 | European Pat. Off. . |
| 0276743 | 7/1992 | European Pat. Off. . |
| 0618020 | 10/1994 | European Pat. Off. . |
| 3522631 | 2/1986 | Germany . |
| 3712043 | 10/1988 | Germany . |
| 4040360 | 6/1991 | Germany . |
| 4421005 | 12/1995 | Germany . |

OTHER PUBLICATIONS

An English language abstract of JP 52–058047, May 13, 1977.

K. Eckelsbach et al., "Schedule–Free Rolling Strategies Based on Contour Control for Flexible Hot Strip Mill Concepts," ISIDM '97 Conference Proceedings, pp. 163–171 (1997).

*Primary Examiner*—Ed Tolan
*Attorney, Agent, or Firm*—Greenblum & Bernstein, P.L.C.

[57] ABSTRACT

A method for improving the contour of rolled material over at least one segment of a rolling schedule including a plurality of rolling processes. The method includes associating at least one quality criterion with at least one rolling stand of at least one of the plurality of rolling processes, optimizing the at least one quality criterion using a mathematical formula, predetermining at least one work roll shift for the plurality of rolling processes over the at least one segment of the rolling schedule based on an optimization of the at least one quality criterion, and axially shifting at least one work roll of the at least one rolling stand.

52 Claims, 3 Drawing Sheets

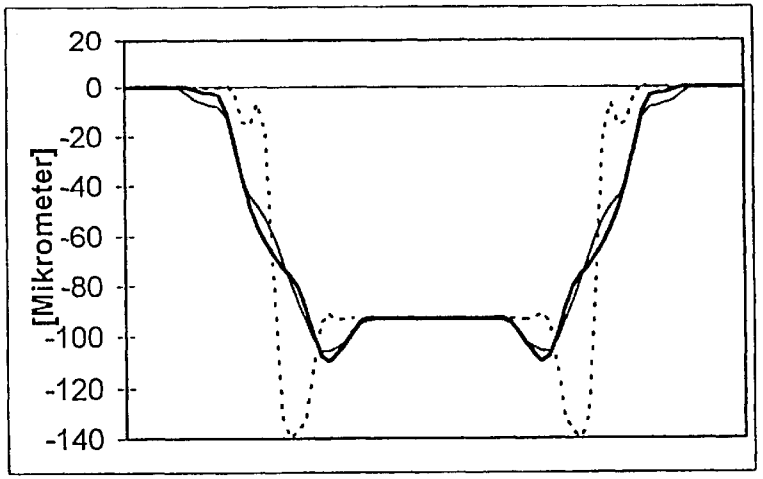
Fig. 2a
Fig. 2b
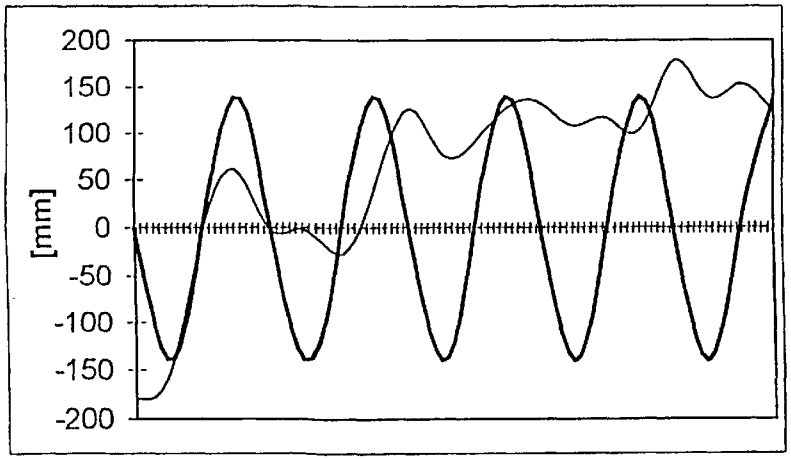
Fig. 2c
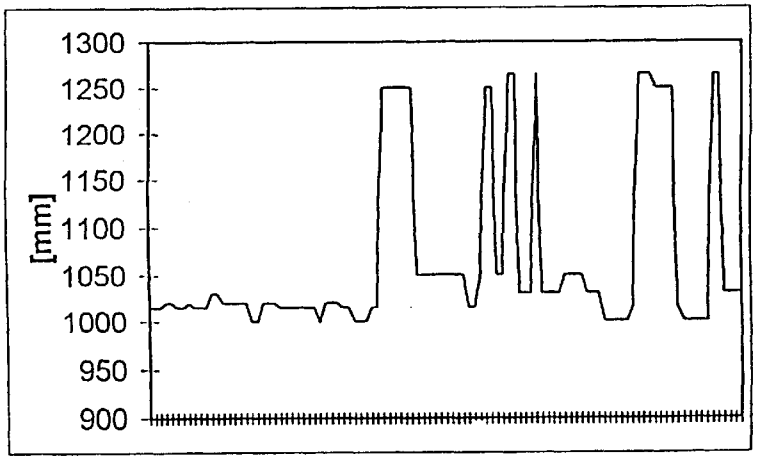
Fig. 2d

METHOD FOR IMPROVING THE CONTOUR OF ROLLED MATERIAL

CROSS-REFERENCE TO RELATED APPLICATIONS

The present application claims priority under 35 U.S.C. § 119 of Austrian Patent Application No. A 715/98, filed on Apr. 29, 1998, the disclosure of which is expressly incorporated by reference herein in its entirety.

BACKGROUND OF THE INVENTION

1. Field of the Invention

The present invention relates to a method for improving the contour of rolled material. Specifically, the present invention relates to a method for increasing the rolled material length within a rolling schedule or for achieving a more free, customized configuration of the rolling schedule, without regard to the varying width of the strips. The present invention may be achieved by axially shifting at least one of the work rolls of at least one rolling stand in hot rolling or cold rolling plants. The axial shifting may occur as a function of a quality criterion, which may be in the form of a mathematical function, which is optimized.

2. Discussion of Background Information

During rolling, in particular during hot rolling, the contour of the work rolls may be subjected to continuous changes within a rolling schedule. The rolling schedule includes the rolling processes between two work roll changes. The work rolls wear significantly at the edge of the rolling stock. The resulting changes in the contour may be compensated for by axially shifting the work rolls.

EP 0276 743 B1, for example, discloses a type of cyclical shifting, wherein a specific shifting path of the work rolls is set so that the wearing of the rolls and the thermal roll crown is distributed more uniformly in the axial direction. However, this method is inadequate to achieve a sufficiently smooth roll contour.

EP 0 219 844 B1 discloses a method for setting the profile of rolling stock by axially adjusting the positions of an upper and lower work roll in opposite directions. In this case, the profile of each work roll is determined during rolling. From this profile, the gap between the work rolls is determined as a function of the magnitude of the relative adjustment of the roll positions. Thus, later, it is possible to determine which magnitude of the adjustment of the roll positions may produce a smoother configuration in the axial direction for the gap inside the contact region between the workpiece and work rolls. This document discloses the calculation of only the subsequent shift position.

It may be gathered from the article titled "Schedule-Free Rolling Strategies Based on Contour Control for Flexible Hot Strip Mill Concepts" by K. Eckelsbach, G. Kneppe, D. Rosenthal, H. Wolters, SMS Schloemann-Siemag AG, D üsseldorf and Hilchenbach/Germany, ISIDM '97 Conference Proceedings, pages 163–171, that, in the case of contour monitoring in hot strip rolling mills, use is made of a process model from which suitable shift positions of the work rolls are derived. Anomalies thereby occurring in the contours, admittedly of the hot rolled strip, are described by a quality criterion which can be treated mathematically. As shown on page 168 of this article, the roll shift positions are determined from one strip to the next in each case.

EP 0 618 020 A1 discloses a method for achieving a prescribed target contour of a rolled strip, it being possible to use various control elements to achieve this target contour when using at least two rolling stands of a hot strip train or when using at least two roll passes in a reversing stand. If a strip contour deviates from the target contour, the mechanical control elements are used to produce a minimum deviation of the calculated strip shape from the target contour. In this case, the optimization of the strip contour is disclosed for one strip.

DE 37 12 043 A1 discloses a control device wherein the current strip profile is analyzed, inter alia, to subsequently carry out an optimum axial shift of axially shiftable rolls to achieve an unstressed hot rolled strip. DE 40 40 360 A1 discloses a control concept for each strip currently being worked, certain model equations and control elements being adapted based on measured variables.

With respect to these last two publications, a plurality of strips are never taken into account in advance.

DE 44 21 005 A1 describes a pass schedule optimization by using process models which supply the number of the passes, the rolling forces during the individual passes, etc. However, determining axial shift positions of the work rolls is not part of the pass schedule optimization.

SUMMARY OF THE INVENTION

The method of the present invention permits the rolled material length to be increased in a rolling schedule, i.e., between two work roll changes, and allows a more free configuration of rolling schedules (SFR—"Schedule Free Rolling"), particularly where the width of the pieces of rolling stock alternatively increase and decrease. More specifically, the present invention achieves an improved contour of the rolling stock because the contour of the work rolls, or of the roll gap formed thereby, is as smooth as possible for each piece of rolling stock over the entire width of the piece of rolling stock. In particular, the invention provides fewer and less severe contour defects, such as, for example, "High Spots" (which are local elevations in the strip owing to work rolls with excessive local wear), in the overall rolling schedule for strips.

In accordance with one aspect of the invention, for each rolling stand, of which there are at least one, there is one quality criterion set up to be applied to at least a segment of the rolling schedule. The segment of the rolling schedule may include several rolling processes. The respective roll shifts, moreover, may be predetermined for all rolling processes of the particular segment of the rolling schedule based on the optimization of the quality criterion.

The invention is advantageous in that for each rolling stand, it is possible to obtain a more favorable shift position of the work rolls (i.e, rolls below or previous for short) for the next rolling process. Further, many, or possibly all, of the subsequent rolling processes may be taken into account. Thus, the roll shifts for the first rolling processes, and the consequences associated therewith (such as, for example, wear of the rolls), do not restrict the possibility of shifting the rolls for the following or subsequent rolling processes. The present invention makes it possible, for the first time, to make the best use of the different possibilities of shifting the rolls to improve the contour of the rolls, and thus the rolling stock, by simultaneously monitoring or taking account of many, if not all, of the pieces of rolling stock or of the rolling processes of a rolling schedule. Through the predetermination of the shift positions of the rolls, the invention permits the wear of the rolls to be optimized, thereby prolonging the service life of the rolls, and thereby increasing the rolled material length for a rolling schedule.

A rolling process is understood here to be that process whereby a piece of rolling stock is worked in a rolling stand between the rolls.

In accordance with one embodiment of the invention, the quality criterion may be an overall objective function, which is formed by summing individual objective functions. Further, at least one objective function may be associated with each rolling process of a piece of rolling stock of the relevant rolling schedule segment.

It is possible, moreover, to take into account all, or at least a plurality, of the pieces of rolling stock for the quality criterion by using the overall objective function. Thus, it is not the quality of individual pieces of rolling stock or material, such as strips, which is sequentially evaluated and optimized, but the quality of the overall rolling schedule or segment of the rolling schedule. It may be sufficient in this case to set up an objective function for each rolling process. Each objective function may evaluate the properties of the rolls either before, during or after the rolling process. However, it may be advantageous, particularly in the case of long pieces of rolling stock, to evaluate the properties of the rolls for a piece of rolling stock several times during a rolling process. For example, evaluate the properties before the rolling process, during the rolling process and after the rolling process, because the properties of the rolls, for example, their thermal roll crown, may change during a lengthy rolling process.

In accordance with another aspect of the invention, it may be advantageous to derive the objective function from at least one of the respective roll contours or from the roll gap contour thereby formed.

This may ensure that the objective function is set up or based on the property of the rolls, namely the roll contours, that are acting on the contour of the rolling stock. For example, it is possible to set up the objective function after each rolling process acts upon a piece of rolling stock, thereby taking account of the roll shift, on the basis of the current roll contours, at least over the width of the piece of rolling stock. The objective function may, for example, include sums or integrals over squared derivatives or differential quotients or over squared deviations of the roll contours from a target contour, a mean value or a regressed contour.

In this case, the roll contours may be determined from models. The model may stipulate which influences on the rolls the model takes into account. In this case, roll contour may be understood as the contour which results from taking account of all influences or partial quantities set forth below. For example, if the roll wear is the only factor taken into account, then only the wear contours of the two rolls are considered. Other factors, such as bending, flattening or thermal roll crown, are not considered. The quality of these roll contours over the width of each considered piece of rolling stock, and thus the quality of the shift strategy, are described by the objective function, which is then maximized while observing certain restrictions, or minimized in the case of evaluating the anomalies of the rolls.

In accordance with another aspect of the present invention, the model may be a process model, which includes properties of the rolling stock, such as stress distribution or material flow.

In accordance with another aspect of the invention, at least one of the following influences may be taken into account in determining the objective function based on at least one of the roll contours or the roll gap contour: the roll wear, the respective roll grind, the thermal roll crown, the roll deflection due to rolling force and roll bending, and the variable roll shifts which are determined based on special methods for controlling profile and flatness (for example by means of CVC methods). This ensures that the actual conditions at the rolling stand are appropriately taken into account in the objective function.

It is, moreover, possible to determine the objective function over the entire width of the work rolls. This may be particularly important when considering a segment of the rolling schedule, because the remaining course of the rolling schedule remains unconsidered and a correspondingly smooth contour of the rolls must be obtained, even where there are either narrower or wider pieces of rolling stock that follow. Thus, if the optimization is carried out sequentially over segments of the rolling schedule, the evaluation of at least one of the work roll contours or the roll gap contour may be performed after each rolling process over the entire width of the rolls or the roll gap (not only over the region of the rolling stock). This is so because the course of the rolling schedule after the segment just considered is not taken into account in the current optimization.

In accordance with yet another aspect of the invention, the objective function may be fashioned with the respective piece of rolling stock over the contact width of the work rolls. The roll contours or the roll gap contour is, therefore, evaluated only over the strip width, because only this part is relevant for the quality of the current piece of rolling stock and, moreover, all the pieces of rolling stock are considered when optimizing the overall rolling schedule.

In accordance with one aspect of the invention, the objective function may be derived on the basis of roll contours which are represented numerically in relation to roll grid points, or the roll gap contour resulting therefrom. For setting up the objective function, this generally constitutes a simpler, less time-consuming basis for optimization, compared to analytical representations. It may be preferable to numerically take into account some influences, such as, for example, the thermal roll crown, for which the temperature distribution in the roll is determined by solving the thermal conduction equation.

In accordance with another aspect of the invention, it is possible for the invention to include one or more of the following, in any combination.

For example, in accordance with one aspect of the invention, the objective function may contain the sum over the preferably weighted squares of the first and second differential quotients at the roll grid points of the roll contours or the roll gap contour.

Further, the goal of the class of objective functions, termed Z1 below, may be to achieve roll contours which are as flat as possible without steep gradients and sharp notches.

In accordance with another aspect of the invention, the objective function may contain the sum of the squared deviations of the roll contours or of the roll gap contour at the roll grid points from the mean value or the regression curve. This class of objective functions is described with respect to Z2 below.

It is, moreover, possible for the objective function to contain the sum of the squared deviations of at least one of the work roll contours or the roll gap contour at the roll grid points from a prescribed target contour. This class of objective functions is described with respect to Z3 below.

It is also possible, in accordance with the present invention, to set up the objective function based on analytically represented roll contours or the roll gap contour resulting therefrom. This has the advantage of a more exact representation of the roll contours. In accordance with another aspect of the invention, the following possibilities may be included, both individually and in combinations with one another, for such an objective function:

It is, for example, possible that the objective function includes the integral over the preferably weighted squared first and second derivatives of the roll contours or the roll gap contour. The aim of this class of objective functions, termed Z1 below, is to achieve roll contours which are as flat as possible without steep gradients and sharp notches.

Further, the objective function may include, in accordance with the present invention, the integral over the squared deviations of the roll contours or the roll gap contour from the mean value or the regression curve. This objective function belongs to the class Z2, as discussed below.

It is also possible for the objective function to include the integral over the squared deviations of the roll contours or the roll gap contour from a prescribed target contour. This objective function belongs to the class Z3.

In accordance with another aspect of the invention, the overall objective function may be subjected to mathematical optimization. In this way, the suitable shifts of the rolls for the rolling processes of the considered segment of the rolling schedule (or for the overall rolling schedule) may be calculated simply and with the aid of a computer.

It may be advantageous to perform the mathematical optimization using a method from non-linear optimization, for example an SQP method (Sequential Quadratic Programming), or a genetic algorithm (Genetic Programming) or some combination thereof. The SQP method is known in the art, as described in SCHITTKOWSKI, Klaus: On the Convergence of a Sequential Quadratic Programming Method with an Augmented Lagrangian Line Search Function; Mathematische Operationsforschung und Stafistik, Series Optimization, Vol 14 (1983) No.2, 197–216. An SQP method may be particularly suitable for solving problems which have restrictions. Genetic algorithms are known in the art such as, for example, GOLDBERG, David E.: Genetic Algorithms in Search, Optimization, and Machine Learing. Addison-Wesley Publishing Company, Inc., Reprinted with corrections January, 1989, Reading, Mass., USA, which is incorporated herein by reference in its entirety.

It may be preferable to use the genetic algorithm to determine the initial values of the roll shift.

In accordance with another aspect of the invention, the mathematical optimization may take into account restrictions which depend on the rolling schedule or the rolling plant, for example limiting values for shifting the rolls.

When determining the shift positions, certain restrictions may now be observed for each piece of rolling stock (for example, each strip) or each rolling process or pass to control the profile and/or the flatness. Restrictions which may be observed include, without limitation, the maximum and minimum possible or desired shift position of the rolls; the maximum shift distance between two successive pieces of rolling stock or rolling processes or passes; the maximum deviation of the shift position from a prescribed desired position value for each piece of rolling stock or each rolling process or pass.

In accordance with yet another aspect of the present invention, the restrictions may also be determined individually for each piece of rolling stock as a function of the rolling schedule and of the roll grind (for example, the maximum shift distance between two strips can be selected in accordance with the interval between these passes, or the rolling stock thickness or the pass period). The result is a non-linear, restricted optimization problem which may be solved by means of SQP methods.

The ability of the shift positions of the rolls for all the rolling processes of the segment of the rolling schedule to be used as optimization variables for the mathematical optimization, may permit a very flexible configuration of the shift positions.

In accordance with another aspect of the invention, the mathematical optimization may be based on a shift function whose free variables may be determined in the mathematical optimization. This parametrization may reduce the number of variables in the optimization, and thus reduce the dimension of the optimization problem, thereby simplifying and accelerating the mathematical optimization. Examples of suitable stipulated shift functions whose free parameters are determined by optimization include: shifting in accordance with a Fourier polynomial, the Fourier coefficients being determined by optimization; or shifting in accordance with a cubic spline function, the functional values at the interpolation points representing the optimization variables.

Thus, for an arbitrarily prescribed rolling schedule, an optimum shift strategy of the rolls may be determined by optimizing the shift positions or the shift function while taking account of roll wear, thermal roll crown and roll deflection by rolling force and roll bending, with the result that the least possible contour defects occur in the course of the entire rolling schedule.

If working with long pieces of rolling stock, several shift positions of the rolls for one rolling process may be determined. The corresponding shift of the rolls may then be performed during the rolling process from one position to the next, as determined for the respective roll by optimizing the shift positions or the shift function.

In accordance with another aspect of the invention, the mathematical optimization may be further simplified by having the shift of the two rolls of a rolling stand be performed dependent on one another. For example, the two rolls of a rolling stand may be shifted by the same amount but in different directions.

If, on the other hand, the two rolls of a rolling stand are shifted independently of one another, a higher degree of flexibility in shifting the work rolls may be achieved.

If the quality criterion is applied to the entire rolling schedule, it is possible to achieve a particularly effective optimization of the shift positions while including all the pieces of rolling stock.

Generally, if the optimization is performed offline before the start of the rolling schedule, it is not necessary to take account of restrictive computer time stipulations.

If the optimization is performed online during the rolling schedule, the current roll contours may be taken into account, and this enhances the quality of the calculated shift positions.

Optimization online enhances the quality of the calculated shift positions because the quality criterion is set up and optimized online repeatedly during the rolling schedule after one or more pieces of rolling stock.

The present invention can also be described as a method for improving the contour of rolled material over at least one segment of a rolling schedule including a plurality of rolling processes. The method of the present invention may include associating at least one quality criterion with at least one rolling stand the at least one rolling stand including a first work roll and a second work roll and the at least one quality criterion including a plurality of rolling processes. The method may also include optimizing at least one quality criterion, which is defined by a mathematical formula, predetermining a plurality of roll shifting positions for at least one work roll of at least one rolling stand for the plurality of rolling processes over at least one segment of the rolling schedule. The plurality of roll shifting positions may be based on an optimization of at least one quality criterion. The method may also include axially shifting at least one work roll in accordance with the plurality of roll shifting positions predetermined.

In accordance with the present invention, the rolled material length may increase between two consecutive work roll changes. It is further possible for the method to include a freely configured rolling schedule wherein the rolled material is strips of varying widths.

In accordance with the present invention, the rolling stand may be in either a hot or a cold rolling plant.

In accordance with another aspect of the present invention, the method may include shifting the first work roll of at least one rolling stand in a direction opposite to, but of substantially equal or the same magnitude to the shifting that occurs with respect to the second work roll.

It is further possible, in accordance with the present invention, for the method to include shifting the first work roll independently of the second work roll.

In accordance with yet another aspect of the invention, the quality criterion may be applied to the entire rolling schedule. Further, the method may include performing the optimization either offline, before actually starting the rolling schedule, or online, during the rolling of the rolling schedule. Moreover, the present invention may include performing the optimization repeatedly on line during the actual rolling schedule, the optimization being repeated each time the rolling of at least one piece of rolling material has been completed.

In accordance with another aspect of the invention, the quality criterion may be an objective function, which is formed by summing a plurality of individual objective functions. An individual objective function of the plurality of individual objective functions may be associated with one of the rolling processes of the rolling schedule.

The present invention may also include subjecting the overall objective function to mathematical optimization. The mathematical optimization may include a method for non-linear optimization. The method for non-linear optimization may include at least one of an SQP method or a genetic algorithm. Further, the genetic algorithm may be used to determine initial values of at least one roll shift.

It is further possible for the mathematical optimization to include restrictions which are dependent on the rolling schedule. Moreover, the mathematical optimization may take into account, as variables, several of the shifting positions for at least one work roll for the plurality of rolling processes over at least one segment of the rolling schedule. The invention may further include basing the mathematical optimization on a shift function including free variables determined in the mathematical optimization.

In accordance with another aspect of the invention, the plurality of shifting positions may be determined for at least one long piece of rolling stock for one of the rolling processes for each work roll. Further, a corresponding shifting of the plurality of shifting positions may be successively performed from one determined position to the next, during the rolling of at least one rolling process.

The method may further include basing the objective function on either the roll contour or the roll gap contour, which is formed by the roll contour. Further, the present invention may include deriving the roll contour from at least one model.

According to one aspect of the invention, the method may further include basing the objective function on either the roll contours, or at least one roll contour, or the roll gap contour and taking at least one of the following into account: roll wear, respective roll grind, thermal roll crown, roll deflection or deformation and variable roll shifts determined by special methods for controlling profile and flatness.

In accordance with another aspect of the invention, it is possible to base the objective function on the width of at least one work roll. Moreover, the present invention may include basing the objective function on the contact area between at least one work roll and the respective rolled material.

It may be advantageous for the present invention to include numerically representing the roll contours, or at least one roll contour, or the roll gap contour with respect to a plurality of roll grid points and deriving the objective function from the numerical representation of the roll contours or the roll gap contour.

In accordance with the present invention, the objective function may include a sum over the preferably weighted squares of the first and second differential quotients at the roll grid points of either the roll contours, or at least one roll contour, or the roll gap contour. Or, the objective function may include the sum of the squared deviations of either the roll contours or the roll gap contour at the roll grid points from the mean value or the regression curve. Further, it is possible that the objective function include the sum of the squared deviations of either the roll contours or the roll gap contour at the roll grid points from a prescribed target contour. It may be advantageous for the objective function to include at least one of the following: preferably weighted combination of the sum of the preferably weighted squares of the first and second differential quotients at the roll grid points of either the roll contours or the roll gap contour; the sum of the squared deviations of the roll contours or the roll gap contour at the roll grid points from the mean value or the regression curve; or the sum of the squared deviations of either the roll contours or the roll gap contour at the roll grid points from a prescribed target contour.

It is further possible, in accordance with the present invention, to derive the objective function from either a basis of analytically represented roll contours or the roll gap contour resulting therefrom. The objective function may also include an integral over the preferably weighted squared first and second derivatives of either the roll contours or the roll gap contour. Further, it is possible for the objective function to include an integral of the squared deviations of either the roll contours or the roll gap contour from the mean value or the regression curve. The objective function may include the integral over the squared deviations of either the roll contours or the roll gap contour from a prescribed target contour.

It may be advantageous for the objective function to include at least one of the following: the preferably weighted combination of the integral over the preferably weighted squared first and second derivatives of either the roll contours or the roll gap contour, or the integral over the squared deviations of either the roll contours or the roll gap contour from the mean value or the regression curve; or the integral over the squared deviations of either the roll contours or the roll gap contour from a prescribed target contour.

Another way to state the present invention includes a method for improving the contour of rolling stock over at least one segment of a rolling schedule, which includes a plurality of rolling processes. The method of the present invention may include associating at least one quality criterion with at least one rolling stand of at least one rolling processes. The rolling stand may include two work rolls. The method of the present invention further includes optimizing at least one quality criterion, predetermining at least one first work roll shift position based on optimization of at least one quality criterion, and axially shifting the first work roll in accordance with at least one first work roll shift position.

In accordance with the present invention, the rolling stand may be either in a hot or cold rolling plant.

It may be advantageous to optimize at least one quality criterion using a mathematical formula. It may further be advantageous to optimize at least one quality criterion by monitoring at least one roll contour.

In accordance with the present invention, it is further possible to optimize at least one quality criterion by monitoring at least one roll gap contour, which is formed by at least one roll contour.

It is further possible, in accordance with the present invention, to perform the optimization on line, during the rolling schedule, or off line, before starting the rolling schedule. Further, it may be advantageous to evaluate the rolling stock at least once during the rolling of the rolling schedule at or near one or more rolling stands and to adjust at least one of the shift positions of the first work roll. It may further be advantageous to optimize at least one quality criterion associated with the second work roll and to predetermine at least one shift position of the second work roll based on the optimization of at least one quality criterion associated with the second work roll and to axially shift the second work roll to at least one of the shift positions.

In accordance with another aspect of the invention, for at least one long piece of rolling shock, the method may further include independently determining and performing a plurality of shift positions for the first work roll during the rolling process, and independently determining and performing a plurality of shift positions for the second work roll during at least one rolling process.

Another way to state the present invention is a method for improving the contour of rolling stock over at least one segment of a rolling schedule, which includes several rolling processes. The method may include associating at least one quality criterion with a rolling stand of at least one of several or a plurality of rolling processes. The rolling stand includes at least one work roll. The method may further include optimizing at least one quality criterion for at least one work roll, predetermining a plurality of work roll shift positions for at least one work roll, and axially shifting at least one work roll in accordance with the plurality of work roll shift positions.

In accordance with one aspect of the invention, at least one work roll may include a first and a second work roll and it is possible to axially shift the second work roll in a direction opposing the axial shifting of the first work roll, and in a magnitude approximately equal to the first work roll.

The method in accordance with the present invention may further include optimizing at least one quality criterion each time the rolling of at least one piece of rolling stock has been completed. Further, it is possible to determine the plurality of shifting positions for at least one long piece of rolling stock for at least one rolling process for each of the work rolls and to perform the corresponding shift of the plurality of shifting positions from one determined position to the next during the rolling of at least one of the rolling processes.

It is possible, in accordance with another aspect of the present invention, for the quality criterion to be an objective function, formed by summing a plurality of individual objective functions. The individual objective function may be associated with one of the rolling processes of the rolling schedule.

It is further possible for the method of the invention to include subjecting the overall objective function to mathematical optimization.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting exemplary embodiments of the present invention, in which like reference numerals represent similar parts throughout the several views of the drawings, and wherein:

FIG. 2*a* graphically illustrates the difference between the maximum and minimum total wear of the upper and lower work rolls in a free rolling schedule wherein the strip width varies;

FIG. 2*b* graphically illustrates a diagram of the unloaded roll gap contour of the roll gap formed by two work rolls after the rolling schedule terminates in a free rolling schedule wherein the width of the strips vary;

FIG. 2*c* graphically illustrates the shift positions of a roll in a free rolling schedule wherein the width of the strips vary;

FIG. 2*d* illustrates the width distribution of the strips in a free rolling schedule wherein the width of the strips vary;

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1B:
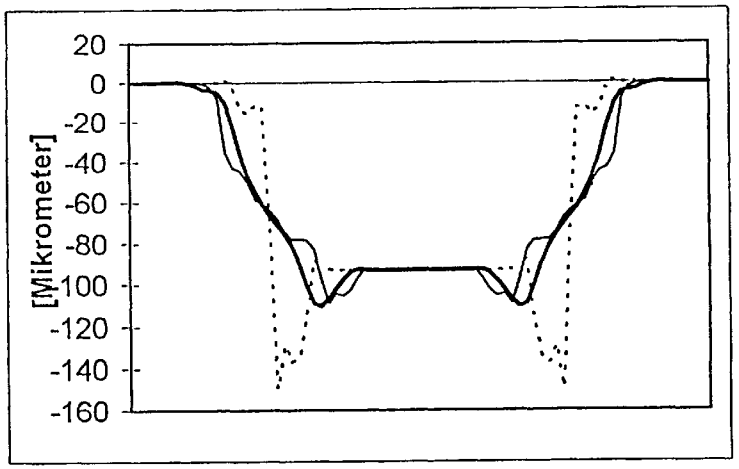
FIG. 1*b* graphically illustrates a diagram of the unloaded roll gap contour of the roll gap formed by two work rolls after termination of the rolling schedule for strips of a coffin shape schedule.
Figure 1D:
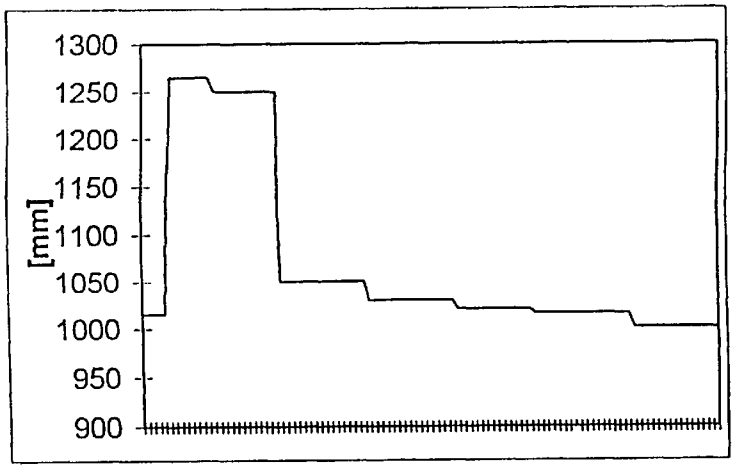
FIG. 1*d* illustrates the width distribution for a coffin shape schedule.
Figure 1A:
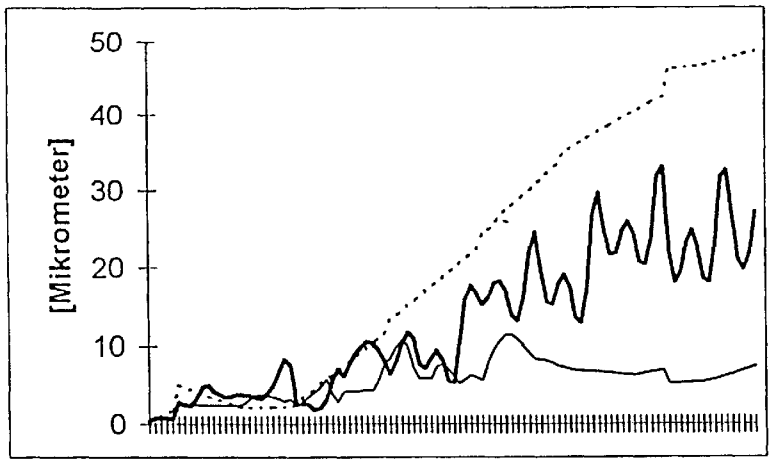
FIG. 1*a* graphically illustrates the difference between the maximum and minimum total wear of the upper and lower work rolls over the strip width (in the strip contact zone) for all strips of a so called coffin shape schedule.
Figure 3A:
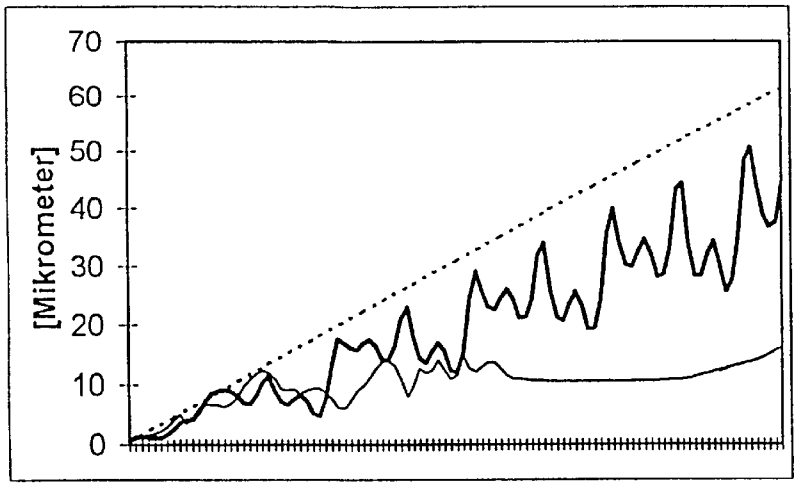
FIG. 3*a* graphically illustrates the difference between the maximum and minimum total wear of the upper and lower work rolls wherein the strips are substantially of equal width.

FIGS. 1*a*, 2*a* and 3*a* diagram the difference between the maximum and minimum total wear of the upper and lower work rolls over the respective strip width for all strips of the rolling schedule. In FIGS. 1*a*, 2*a*, and 3*a* the vertical axis represents the difference between the approximate maximum and approximate minimum total wear of the two rolls (in micrometers) over the respective strip width. The horizontal axis gives the respective strip number for all strips of the rolling schedule. The wear of the roll is measured radially relative to the roll, starting from the contour of the newly ground roll and referring to the radius of the roll. A small difference is a sign of a smooth roll contour.

Figure 3B:
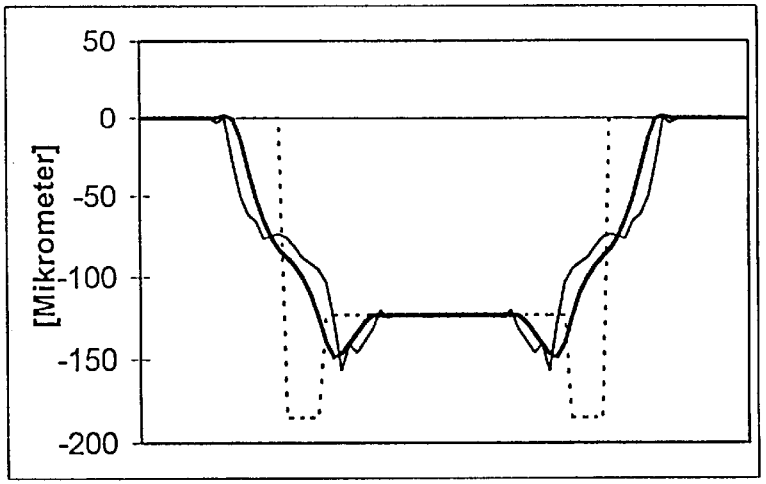
FIG. 3*b* graphically illustrates a diagram of the unloaded roll gap contour of the roll gap formed by two work rolls after the rolling schedule terminates wherein the strips are of substantially equal width.

FIGS. 1*b*, 2*b* and 3*b* diagram the contour of an unloaded roll gap. The roll gap is formed by the two work rolls, after termination of the rolling schedule. In FIGS. 1*b*, 2*b* and 3*b*, the vertical axis represents, in micrometers, the deviation of the roll gap contour from that of the new rolls. The horizontal axis corresponds to the longitudinal roll axis. The wear is measured radially relative to the rolls, starting from the contour of the newly ground rolls.

Figure 1C:
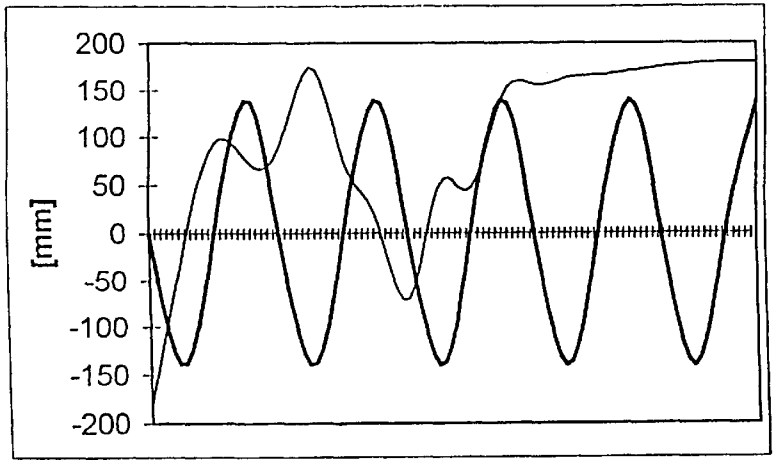
FIG. 1*c* graphically illustrates the shift positions of a roll for strips of a coffin shape schedule.
Figure 3C:
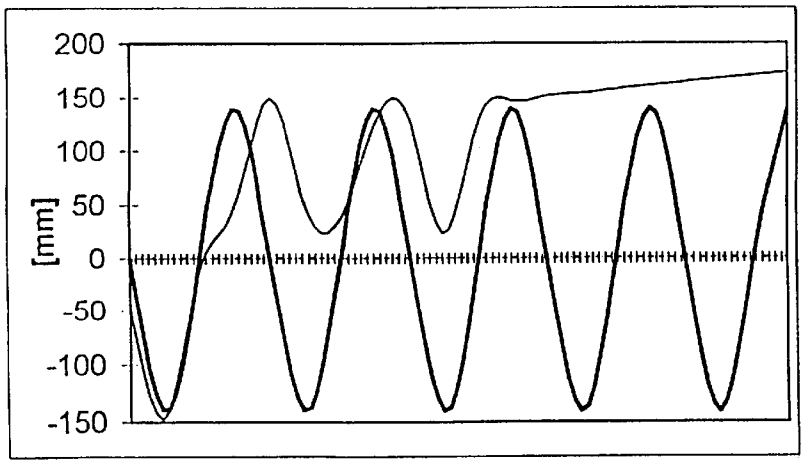
FIG. 3*c* graphically illustrates the shift positions of a roll wherein the strips are of substantially equal width.

FIGS. 1*c*, 2*c* and 3*c* diagram the shift positions of a roll. In FIGS. 1*c*, 2*c*, and 3*c*, the vertical axis represents the shift positions, in millimeters, of the lower roll for each strip of the rolling schedule. The horizontal axis gives the respective strip number for all strips of the rolling schedule. The unshifted initial position of the roll corresponds to the shift position 0 mm.

Figure 3D:
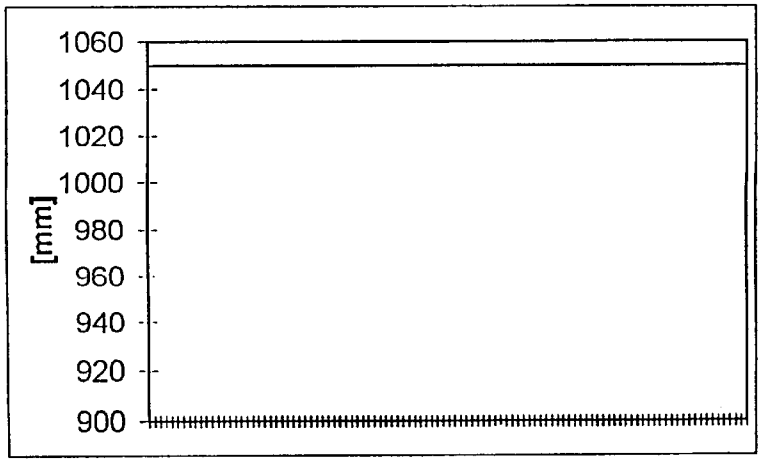
FIG. 3*d* illustrates the width distribution of strips which are substantially equal in width.

FIGS. 1*d*, 2*d*, and 3*d* show the width distribution of the strips. The vertical axis gives the respective strip width, in millimeters, for the strips, which are plotted on the horizontal axis.

Each of the three rolling schedules (represented by FIGS. 1*a*–1*d*; 2*a*–2*d*; and 3*a*–3*d* respectively) comprises 105 strips as pieces of rolling stock. For reasons of symmetry, the shift position of the upper roll may be the mirror image of that of the lower roll, using the center of the stand as a reference. In other words, the absolute value of the shift of the rolls with respect to their unshifted initial position may be identical, but the sign or direction is different.

The Figures, with respect to each rolling schedule (represented by FIGS. 1*a*–1*d*; 2*a*–2*d*; and 3*a*–3*d* respectively), illustrate two different methods used to shift the rolls. For comparison purposes, the results of the method without roll shift are represented by the dashed lines in each of the Figures.

In one method, whose result is represented on the Figures as a thick continuous curve, the rolls were subjected to a cyclic shift in accordance with the prior art. In another method, whose result is represented as a thin continuous curve, the rolls were shifted according to one aspect of the present invention. The aspect of the invention indicated on the figure includes optimizing the overall objective function formed by the addition from objective functions Z2. Here, Z2 has been formed over the roll gap contour by adding the squared deviations of the roll gap contour from the regression line.

For the purpose of optimizing the roll gap contour, only the roll wear as an influence on the roll gap contour was considered. Moreover, for each strip, the roll gap contour was evaluated only once for each rolling process, specifically after the rolling process. It is noted that, in accordance with the present invention, the evaluation of the roll gap contour or the roll contours may also be performed before or during the respective rolling process. Further, it may be advantageous, particularly in the case of long strips, for the roll gap contour or the roll contours to be evaluated several times for a strip in one rolling process. In other words, evaluate the roll gap contour or the roll contours once before the rolling process, at least once during the rolling process and once after the rolling process, because the properties of the rolls (and, thus, the roll contours) such as, for example, the thermal roll crown, may change during a lengthy rolling process.

Moreover, when using very long pieces of rolling stock, it is possible to determine a plurality of shift positions of the rolls for one rolling process. The corresponding shifting of the rolls is then performed during the rolling process.

All results shown in the FIGS. 1*b*–1*d*, 2*b*–2*d* and 3*b*–3*d* refer to the sixth stand of a seven-stand finishing mill. The aspect of the invention indicated in these figures can be described in detail as follows.

To reduce the dimension of the problem, a predefined type of shifting function based on cubic spline interpolation is used. This means that the interval spanned by the number of strips is partitioned into sub-intervals with the roll shifting positions at the corresponding nodes being the design parameters (variables) for the optimization problem. Based on the shifting positions calculated for the nodes, the remaining roll shifting positions (one for each strip) are determined by cubic spline interpolation between the node values.

When the upper and the lower work rolls may be shifted the same magnitude, but in opposite directions, the shifting positions of the upper work roll result from those of the lower work roll. Thus, in this case, the upper work roll does not require any further variables to model its shifting.

In this particular case, the optimization problem is solved by a Sequential Quadratic Programming method, using the roll shifting positions of cyclic shifting as starting values for the iterative procedure.

In each iteration step the objective function is determined by calculating the work roll contours caused by work roll wear and the resulting roll gap contour after each simulated rolling process of one strip of the rolling schedule.

The work roll contours are calculated with respect to the roll shifting positions of the corresponding iteration step and to pass schedule data like rolling force, strip width etc. for all strips of the whole rolling schedule. The work roll contours are represented numerically in axially discrete nodes for each work roll.

After each computed rolling process of one strip of the rolling schedule, the quality of the roll gap contour in the strip contact zone is evaluated by the sum of squared deviations of the roll gap contour values from their regression line. This calculation contributes to the objective function.

The objective function is given by the sum of the contributions of all strips of the rolling schedule and may be minimized subject to the following restrictions: maximum roll shifting position on operator- and drive-side and the maximum shifting distance between two consecutive strips.

The optimization controls the roll shifting positions for all strips of the rolling schedule (one position for each strip).

When actually rolling the strips of the rolling schedule, the upper and the lower work roll of the considered mill stand should be shifted to the calculated positions before the corresponding strip enters the mill stand (work roll shifting should take place during the idle time between two strips).

It should be noted that the procedure described above refers to only one particular aspect of the invention and indicates just one way of practicing the invention and is not intended to restrict the extent or scope of the invention.

FIGS. 1*a*, 2*a* and 3*a* show that, in the case of the method according to the invention (thin continuous curve), there is an altogether smaller difference in wear, and thus smoother roll gap contour over the width of the respective strip than in the case of the method with cyclic shifting or in the case of the method without shifting. Above all, it is possible still to ensure a smooth roll gap contour and thus a smooth strip contour, over the respective strip width even toward the end of the rolling schedule (see FIGS. 1*a* and 3*a*), and this permits an increase in the pieces of rolling stock to be rolled, and thus causes an increase in the quantity of rolled material.

FIGS. 1*b*, 2*b* and 3*b* represent the unloaded roll gap contour after 105 rolled strips. As can be seen from FIGS. 1*b*, 2*b* and 3*b*, the method according to the invention exhibits a roll wear somewhat comparable to the method with cyclic shift, but delivers better results because of the optimized shift.

In FIG. 1*c*, FIG. 2*c* and FIG. 3*c*, the horizontal line through the origin corresponds to the method without shifting the rolls. The method in accordance with cyclic shift is limited to periodically repeating shifts. As shown in FIG. 1*c*, FIG. 2*c*and FIG. 3*c*, the method according to one aspect of the present invention deviates from the method with cyclic shift as a consequence of the optimization according to the invention.

It is possible, in accordance with the present invention, to use the invention in continuous operation and in a reverse operation. It is also possible, in accordance with the present invention, to use the invention for single-stand and multi-stand trains. Because the work rolls may have an arbitrary grind, the method is also good for cylindrical or conventionally parabolically ground rolls or rolls with a CVC-grind.

Departures in various respects can be made from the foregoing exemplary embodiments without departing from the fundamental concept of the invention. It is noted that the foregoing examples and embodiments have been provided merely for the purpose of explanation and are in no way to be construed as limiting of the present invention. While the present invention has been described with reference to an exemplary embodiment, it is understood that the words which have been used herein are words of description and illustration, rather than words of limitation.

Changes may be made, within the purview of the appended claims, as presently stated and as amended, without departing from the scope and spirit of the present invention and its aspects. Although the present invention has been described herein with reference to particular methods, means, materials and embodiments, the present invention is not intended to be limited to the particulars disclosed herein; rather, the present invention extends to all functionally equivalent structures, methods and uses, such as are within the scope of the appended claims.

What is claimed:

1. A method for improving the contour of rolled material over at least one segment of a rolling schedule including a plurality of rolling processes, comprising:

associating at least one quality criterion with at least one rolling stand, the at least one rolling stand including a first work roll and a second work roll and the at least one quality criterion including a plurality of rolling processes;

optimizing the at least one quality criterion, the quality criterion being defined by a mathematical formula;

predetermining a plurality of roll shifting positions for at least one work roll of the at least one rolling stand for the plurality of rolling processes over the at least one segment of the rolling schedule, the plurality of roll shifting positions being based on an optimization of the at least one quality criterion; and axially shifting the at least one work roll in accordance with the plurality of roll shifting positions predetermined.

2. The method of claim 1, wherein the rolled material length between two consecutive work roll changes increases.

3. The method of claim 1, further comprising a freely configured rolling schedule and the rolled material being strips of varying widths.

4. The method of claim 1, wherein the at least one rolling stand is in a hot rolling plant.

5. The method of claim 1, wherein the at least one rolling stand is in a cold rolling plant.

6. The method of claim 1, further comprising shifting of the first work roll of the at least one rolling stand in an opposing direction but of substantially equal magnitude to the shifting of the second work roll.

7. The method of claim 1, further comprising shifting of the first work roll independently of the shifting of the second work roll.

8. The method of claim 1, further comprising:

applying the quality criterion to the entire rolling schedule.

9. The method of claim 1, further comprising:

performing the optimization offline before actually starting a rolling of the rolling schedule.

10. The method of claim 1, further comprising:

performing the optimization online during the rolling of the rolling schedule.

11. The method of claim 10, further comprising:

performing the optimization repeatedly online during the actual rolling schedule, the optimization being repeated each time the rolling of at least one piece of rolling material has been completed.

12. The method of claim 1, wherein the quality criterion is an objective function formed by summing a plurality of individual objective functions, an individual objective function of the plurality of individual objective functions being associated with one of the at least one rolling processes of the rolling schedule.

13. The method of claim 12, further comprising:

subjecting the overall objective function to mathematical optimization.

14. The method of claim 13, wherein the mathematical optimization includes a method for non-linear optimization.

15. The method of claim 14, wherein the method for non-linear optimization includes at least one of an SQP method or a genetic algorithm.

16. The method of claim 15, wherein the genetic algorithm is being used to determine initial values of the at least one roll shift.

17. The method of claim 13, wherein the mathematical optimization includes restrictions dependent on the rolling schedule.

18. The method of claim 13, wherein the mathematical optimization takes into account as variables the plurality of shifting positions for the at least one work roll for the plurality of rolling processes over the at least one segment of the rolling schedule.

19. The method of claim 13, further comprising:

basing the mathematical optimization on a shift function including free variables determined in the mathematical optimization.

20. The method of claim 12, wherein the plurality of shifting positions are determined for at least one piece of rolling stock for one of the at least one rolling processes for at least one work roll, a corresponding shifting of the plurality of shifting positions being successively performed from one determined position to the next during a rolling of the one of the at least one rolling processes.

21. The method of claim 12, further comprising:

basing the objective function on at least one of at least one work roll contour and a roll gap contour, the roll gap contour being formed by an upper work roll and a lower work roll.

22. The method of claim 21, further comprising:

deriving the roll contour from at least one model.

23. The method of claim 21, further comprising:

basing the objective function on at least one of at least one work roll contour and the roll gap contour; and taking at least one of the following into account: roll wear, respective roll grind, thermal roll crown, roll deflection and variable roll shifts determined by special methods for controlling profile and flatness.

24. The method of claim 21, further comprising:

basing the objective function on the width of the at least one work roll.

25. The method of claim 21, further comprising:

basing the objective function on a contact area of the at least one work roll with the respective rolled material.

26. The method of claim 21, further comprising:

numerically representing the roll contours or the roll gap contour with respect to a plurality of roll grid points; and deriving the objective function from the numerical representation of the roll contours or the roll gap contour.

27. The method of claim 12, further comprising:

deriving the objective function from either a basis of analytically represented roll contours or the roll gap contour resulting therefrom.

28. A method for improving the contour of rolled material over at least one segment of a rolling schedule including a plurality of rolling processes, comprising:

associating at least one quality criterion with at least one rolling stand, the at least one rolling stand including a first work roll and a second work roll and the at least one quality criterion including a plurality of rolling processes;

optimizing the at least one quality criterion, the quality criterion being defined by a mathematical formula;

predetermining a plurality of roll shifting positions for at least one work roll of the at least one rolling stand for the plurality of rolling processes over the at least one segment of the rolling schedule, the plurality of roll shifting positions being based on an optimization of the at least one quality criterion; and axially shifting the at least one work roll in accordance with the plurality of roll shifting positions predetermined, wherein the quality criterion is an objective function formed by summing a plurality of individual objective functions, an individual objective function of the plurality of individual objective functions being associated with one of the at least one rolling processes of the rolling schedule, and wherein the objective function includes a sum over weighted squares of first and second differential quotients at roll grid points of at least one of the at least one work roll contour and the roll gap contour.

29. A method for improving the contour of rolled material over at least one segment of a rolling schedule including a plurality of rolling processes, comprising:

associating at least one quality criterion with at least one rolling stand, the at least one rolling stand including a first work roll and a second work roll and the at least one quality criterion including a plurality of rolling processes;

optimizing the at least one quality criterion, the quality criterion being defined by a mathematical formula;

predetermining a plurality of roll shifting positions for at least one work roll of the at least one rolling stand for the plurality of rolling processes over the at last one segment of the rolling schedule the plurality of roll shifting positions being based on an optimization of the at least one quality criterion; and axially shifting the at least one work roll in accordance with the plurality of roll shifting positions predetermined, wherein the quality criterion is an objective function formed by summing a plurality of individual objective functions, an individual objective function of the plurality of individual objective functions being associated with one of the at least one rolling processes of the rolling schedule, and wherein the objective function includes a sum of squared deviations of at least one of at least one work roll contour and the roll gap contour at roll grid points from a mean value or a regression curve.

30. A method for improving the contour of rolled material over at least one segment of a rolling schedule including a plurality of rolling processes, comprising:

associating at least one quality criterion with at least one rolling stand, the at least one rolling stand including a first work roll and a second work roll and the at least one quality criterion including a plurality of rolling processes;

optimizing the at least one quality criterion, the quality criterion being defined by a mathematical formula;

predetermining a plurality of roll shifting positions for at least one work roll of the at least one rolling stand for the plurality of rolling processes over the at least one segment of the rolling schedule, the plurality of roll shifting positions being based on an optimization of the at least one quality criterion; and axially shifting the at least one work roll in accordance with the plurality of roll shifting positions predetermined, wherein the quality criterion is an objective function formed by summing a plurality of individual objective functions, an individual objective function of the plurality of individual objective functions being associated with one of the at least one rolling processes of the rolling schedule, and wherein the objective function includes a sum of squared deviations of at least one of at least one work roll contour and the roll gap contour at roll grid points from a prescribed target contour.

31. A method for improving the contour of rolled material over at least one segment of a rolling schedule including a plurality of rolling processes, comprising:

associating at least one quality criterion with at least one rolling stand, the at least one rolling stand including a first work roll and a second work roll and the at least one quality criterion including a plurality of rolling processes;

optimizing the at least one quality criterion, the quality criterion being defined by a mathematical formula;

predetermining a plurality of roll shifting positions for at least one work roll of the at least one rolling stand for the plurality of rolling processes over the at least one segment of the rolling schedule, the plurality of roll shifting positions being based on an optimization of the at least one quality criterion; and axially shifting the at least one work roll in accordance with the plurality of roll shifting positions predetermined, wherein the quality criterion is an objective function formed by summing a plurality of individual objective functions, an individual objective function of the plurality of individual objective functions being associated with one of the at least one rolling processes of the rolling schedule, and wherein the objective function includes at least one of a weighted combination of a sum of weighted squares of first and second differential quotients at roll grid points of at least one of at least one work roll contour and the roll gap contour, and a sum of squared deviations of at least one of at least one work roll contour and the roll gap contour at roll grid points from a mean value or a regression curve, and a sum of squared deviations of at least one of at least one work roll contour and the roll gap contour at roll grid points from a prescribed target contour.

32. A method for improving the contour of rolled material over at least one segment of a rolling schedule including a plurality of rolling processes, comprising:

associating at least one quality criterion with at least one rolling stand, the at least one rolling stand including a first work roll and a second work roll and the at least one quality criterion including a plurality of rolling processes;

optimizing the at least one quality criterion, the quality criterion being defined by a mathematical formula;

predetermining a plurality of roll shifting positions for at least one work roll of the at least one rolling stand for the plurality of rolling processes over the at least one segment of the rolling schedule, the plurality of roll shifting positions being based on an optimization of the at least one quality criterion;

axially shifting the at least one work roll in accordance with the plurality of roll shifting positions predetermined, wherein the quality criterion is an objective function formed by summing a plurality of individual objective functions, an individual objective function of the plurality of individual objective functions being associated with one of the at least one rolling processes of the rolling schedule; and deriving the objective function from either a basis of analytically represented roll contours or the roll gap contour resulting therefrom, wherein the objective function includes an integral over weighted squared first and second derivatives of at least one of at least one work roll contour and the roll gap contour.

33. A method for improving the contour of rolled material over at least one segment of a rolling schedule including a plurality of rolling processes, comprising:

associating at least one quality criterion with at least one rolling stand, the at least one rolling stand including a first work roll and a second work roll and the at least one quality criterion including a plurality of rolling processes;

optimizing the at least one quality criterion, the quality criterion being defined by a mathematical formula;

predetermining a plurality of roll shifting positions for at least one work roll of the at least one rolling stand for the plurality of rolling processes over the at least one segment of the rolling schedule, the plurality of roll shifting positions being based on an optimization of the at least one quality criterion;

axially shifting the at least one work roll in accordance with the plurality of roll shifting positions predetermined, wherein the quality criterion is an objective function formed by summing a plurality of individual objective functions, an individual objective function of the plurality of individual objective functions being associated with one of the at least one rolling processes of the rolling schedule; and deriving the objective function from either a basis of analytically represented roll contours or the roll gap contour resulting therefrom, wherein the objective function includes an integral of squared deviations of at least one of at least one work roll contour and the roll gap contour from a mean value or a regression curve.

34. A method for improving the contour of rolled material over at least one segment of a rolling schedule including a plurality of rolling processes comprising:

associating at least one quality criterion with at least one rolling stand, the at least one rolling stand including a first work roll and a second work roll and the at least one quality criterion including a plurality of rolling processes;

optimizing the at least one quality criterion, the quality criterion being defined by a mathematical formula;

predetermining a plurality of roll shifting positions for at least one work roll of the at least one rolling stand for the plurality of rolling processes over the at least one segment of the rolling schedule, the plurality of roll shifting positions being based on an optimization of the at least one quality criterion;

axially shifting the at least one work roll in accordance with the plurality of roll shifting positions predetermined, wherein the quality criterion is an objective function formed by summing a plurality of individual objective functions, an individual objective function of the plurality of individual objective functions being associated with one of the at least one rolling processes of the rolling schedule; and deriving the objective function from either a basis of analytically represented roll contours or the roll gap contour resulting therefrom, wherein the objective function includes an integral over squared deviations of at least one of at least one work roll contour and the roll gap contour from a prescribed target contour.

35. A method for improving the contour of rolled material over at least one segment of a rolling schedule including a plurality of rolling processes, comprising:

associating at least one quality criterion with at least one rolling stand, the at least one rolling stand including a first work roll and a second work roll and the at least one quality criterion including a plurality of rolling processes;

optimizing the at least one quality criterion, the quality criterion being defined by a mathematical formula;

predetermining a plurality of roll shifting positions for at least one work roll of the at least one rolling stand for the plurality of rolling processes over the at least one segment of the rolling schedule, the plurality of roll shifting positions being based on an optimization of the at least one quality criterion;

axially shifting the at least one work roll in accordance with the plurality of roll shifting positions predetermined, wherein the quality criterion is an objective function formed by summing a plurality of individual objective functions, an individual objective function of the plurality of individual objective functions being associated with one of the at least one rolling processes of the rolling schedule; and deriving the objective function from either a basis of analytically represented roll contours or the roll gap contour resulting therefrom, wherein the objective function includes at least one of a weighted combination of an integral over weighted squared first and second derivatives of at least one of at least one work roll contour and the roll gap contour, and an integral over squared deviations of at least one of at least one work roll contour and the roll gap contour from a mean value or a regression curve, and an integral over squared deviations of at least one of at least one work roll contour and the roll gap contour a prescribed target contour.

36. A method for improving the contour of rolling stock over at least one segment of a rolling schedule including a plurality of rolling passes, comprising:

associating at least one quality criterion with at least one rolling stand of the plurality of rolling passes, the at least one rolling stand including a first work roll and a second work roll;

optimizing the at least one quality criterion;

predetermining a plurality of first work roll shift positions based on optimization of the at least one quality criterion; and axially shifting the first work roll in accordance with at least one of the plurality of first work roll shift positions.

37. The method of claim 36, wherein the at least one rolling stand is in a hot rolling plant.

38. The method of claim 36, wherein the at least one rolling stand is in a cold rolling plant.

39. The method of claim 36, further comprising:

optimizing the at least one quality criterion using a mathematical formula.

40. The method of claim 36, further comprising:

optimizing the at least one quality criterion by monitoring at least one roll contour.

41. The method of claim 36, further comprising:

optimizing the at least one quality criterion by monitoring at least one roll gap contour formed by the at least one roll contour.

42. The method of claim 36, further comprising:

performing the optimization on line during the rolling schedule.

43. The method of claim 36, further comprising:

performing the optimization off line before starting the rolling schedule.

44. The method of claim 36, further comprising:

evaluating the rolling stock near or at the at least one rolling stand at least once during a rolling of the rolling schedule; and adjusting the at least one shift position of the first work roll.

45. The method of claim 44, further comprising:

optimizing the at least one quality criterion associated with the second work roll;

predetermining at least one shift position of the second work roll based on the optimization of the at least one quality criterion associated with the second work roll; and axially shifing the second work tool to at least one shift position.

46. The method of claim 44, further comprising:

optimizing the at least one quality criterion associated with the second work roll;

predetermining a plurality of shift positions of the second work roll based on the optimization of the at least one quality criterion associated with the second work roll; and axially shifting the second work roll to at least one of the plurality of shift positions.

47. A method for improving the contour of rolling stock over at least one segment of a rolling schedule including a plurality of rolling processes, comprising:

associating at least one quality criterion with a rolling stand of the plurality of rolling processes, the rolling stand including at least one work roll;

optimizing the at least one quality criterion for the at least one work roll;

predetermining a plurality of work roll shift positions for the at least one work roll; and axially shifting the at least one work roll in accordance with the plurality of work roll shift positions.

48. The method according to claim 47, wherein the at least one work roll includes a first and a second work roll and further comprising:

axially shifting the second work roll in a direction opposing the axial shifting of the first work roll and in a magnitude equal to the first work roll.

49. The method according to claim 47, further comprising:

optimizing the at least one quality criterion each time the rolling of at least one piece of rolling stock has been completed.

50. The method of claim 47, further comprising:

determining the plurality of shifting positions for at least one piece of rolling stock for one of the at least one rolling process for each of the at least one work rolls; and performing the corresponding shift of the plurality of shifting positions from one determined position to the next during a rolling of the one of the at least one rolling processes.

51. The method according to claim 47, wherein the quality criterion is an objective function formed by summing a plurality of individual objective functions, an individual objective function of the plurality of individual objective functions being associated with one of the rolling processes of the rolling schedule.

52. The method of claim 51, further comprising:

subjecting the overall objective function to mathematical optimization.

* * * * *